US012110783B2

(12) United States Patent
Ray et al.

(10) Patent No.: US 12,110,783 B2
(45) Date of Patent: Oct. 8, 2024

(54) AUTOMATED IDENTIFICATION AND APPLICATION OF HYDRAULIC FRACTURING SHUT-IN PARAMETERS

(71) Applicant: Halliburton Energy Services, Inc., Houston, TX (US)

(72) Inventors: Baidurja Ray, Houston, TX (US); Trent L Kennedy, Fort Lupton, CO (US); Sean Michael Simpson, Fort Lupton, CO (US); Austen Murray, Bossier City, LA (US); Hao Sun, Fort Lupton, CO (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/872,928

(22) Filed: Jul. 25, 2022

(65) Prior Publication Data

US 2024/0026774 A1 Jan. 25, 2024

(51) Int. Cl.
*E21B 43/26* (2006.01)
*E21B 47/06* (2012.01)

(52) U.S. Cl.
CPC ..... *E21B 47/06* (2013.01); *E21B 43/26* (2013.01)

(58) Field of Classification Search
CPC ..... E21B 43/2607; E21B 43/26
See application file for complete search history.

(56) References Cited

U.S. PATENT DOCUMENTS 4,398,416 A * 8/1983 Nolte ..... E21B 43/26 166/250.1
4,749,038 A * 6/1988 Shelley ..... E21B 49/008 73/152.52
6,364,015 B1 * 4/2002 Upchurch ..... E21B 43/26 166/308.1
9,500,076 B2 * 11/2016 Walters ..... E21B 43/26
10,753,181 B2 * 8/2020 Roussel ..... E21B 49/00
(Continued)

OTHER PUBLICATIONS

Alwarda, et al.; "Automated Procedure for Quantifying ISIP and Friction Losses from Stage by Stage Hydraulic Fracture Treatment Falloff Data"; Society of Petroleum Engineers, SPE International; SPE-201488-MS; SPE Annual Technical Conference & Exhibition, Oct. 5-7, 2020; 10 pgs.

*Primary Examiner* — Kenneth L Thompson
(74) *Attorney, Agent, or Firm* — Michael Jenney; Parker Justiss, P.C.

(57) ABSTRACT

Disclosed herein is an automated process of identifying shut-in parameters of a hydraulic fracturing operation from hydraulic fracturing treatment (HF) data. Also disclosed is a system and computer program product for automatically determining shut-in parameters from HF data. The HF data can be collected in real time during a HF from various sensors, equipment, or systems typically used in HFs or present at a well site. In one example, a method for automatically determining hydraulic fracturing parameters includes: (1) obtaining HF data, (2) determining a Rate Shut-In (RSI) time from the HF data, (3) determining a Well Shut-In (WSI) time using the RSI, and (4) calculating an Instantaneous Shut-In Pressure (ISIP) value based upon both the RSI and the WSI times, wherein determining the RSI time, the WSI time and calculating the ISIP value are automatically performed by one or more processors.

20 Claims, 9 Drawing Sheets

(56) References Cited

U.S. PATENT DOCUMENTS

| | | | | |
|---|---|---|---|---|
| 11,131,174 | B2 * | 9/2021 | Montgomery | E21B 47/06 |
| 2020/0065677 | A1 | 2/2020 | Iriarte Lopez et al. | |
| 2022/0003229 | A1 * | 1/2022 | Mu | F04B 17/06 |
| 2022/0307371 | A1 * | 9/2022 | Swan | E21B 43/26 |

* cited by examiner

AUTOMATED IDENTIFICATION AND APPLICATION OF HYDRAULIC FRACTURING SHUT-IN PARAMETERS

BACKGROUND

During a hydraulic fracturing ("fracking") treatment, hydraulic fracturing fluid is introduced into a wellbore under high pressure to create cracks or fractures in the reservoir rock through which trapped hydrocarbons (e.g., natural gas and/or petroleum) and connate water can flow from the rock more freely. The wellbore is typically cased, perforated and separated into distinct stages for the hydraulic fracturing. The hydraulic fracturing fluid, which can include water, solids, proppants, chemicals, diverter material, etc., flows through the perforations and into the formation surrounding the wellbore to release the hydrocarbons into the well bore and to the surface. Data, such as pumping pressure, pumping rate, proppant concentrations, etc., is collected from various sensors during hydraulic fracturing treatments. The hydraulic fracturing data can be analyzed to identify parameters of the hydraulic fracturing treatments that can be used to control or modify the treatments. Typically, the hydraulic fracturing data is manually reviewed to identify the parameters, such as shut-in parameters.

SUMMARY

In one aspect, a method for automatically determining hydraulic fracturing parameters is disclosed. In one example, the automatic method includes: (1) obtaining hydraulic fracturing treatment (HF) data, (2) determining a Rate Shut-In (RSI) time from the HF data, (3) determining a Well Shut-In (WSI) time using the RSI, and (4) calculating an Instantaneous Shut-In Pressure (ISIP) value based upon both the RSI and the WSI times, wherein determining the RSI time, the WSI time and calculating the ISIP value are automatically performed by one or more processors.

In another aspect, a system for automatically determining shut-in parameters from HF data from a wellbore is disclosed. In one example the system includes: (1) an interface for receiving HF data, and (2) one or more processors to perform operations. The operations include determining a Rate Shut-In (RSI) time from the HF data, determining a Well Shut-In (WSI) time using the RSI, and calculating an Instantaneous Shut-In Pressure (ISIP) value based upon both the RSI and the WSI times, wherein determining the RSI time, the WSI time and calculating the ISIP value are automatically performed by one or more processors.

In yet another aspect, a computer program product is disclosed that has a series of operating instructions stored on a non-transitory computer readable medium that direct one or more processors to perform operations for automatically determining hydraulic fracturing parameters. In one example the operations include: (1) determining a Rate Shut-In (RSI) time from hydraulic fracturing treatment (HF) data, (2) determining a Well Shut-In (WSI) time using the RSI; and (3) calculating an Instantaneous Shut-In Pressure (ISIP) value based upon both the RSI and the WSI times, wherein determining the RSI time, the WSI time and calculating the ISIP value are automatically performed.

BRIEF DESCRIPTION

Reference is now made to the following descriptions taken in conjunction with the accompanying drawings, in which.

Figure 4:
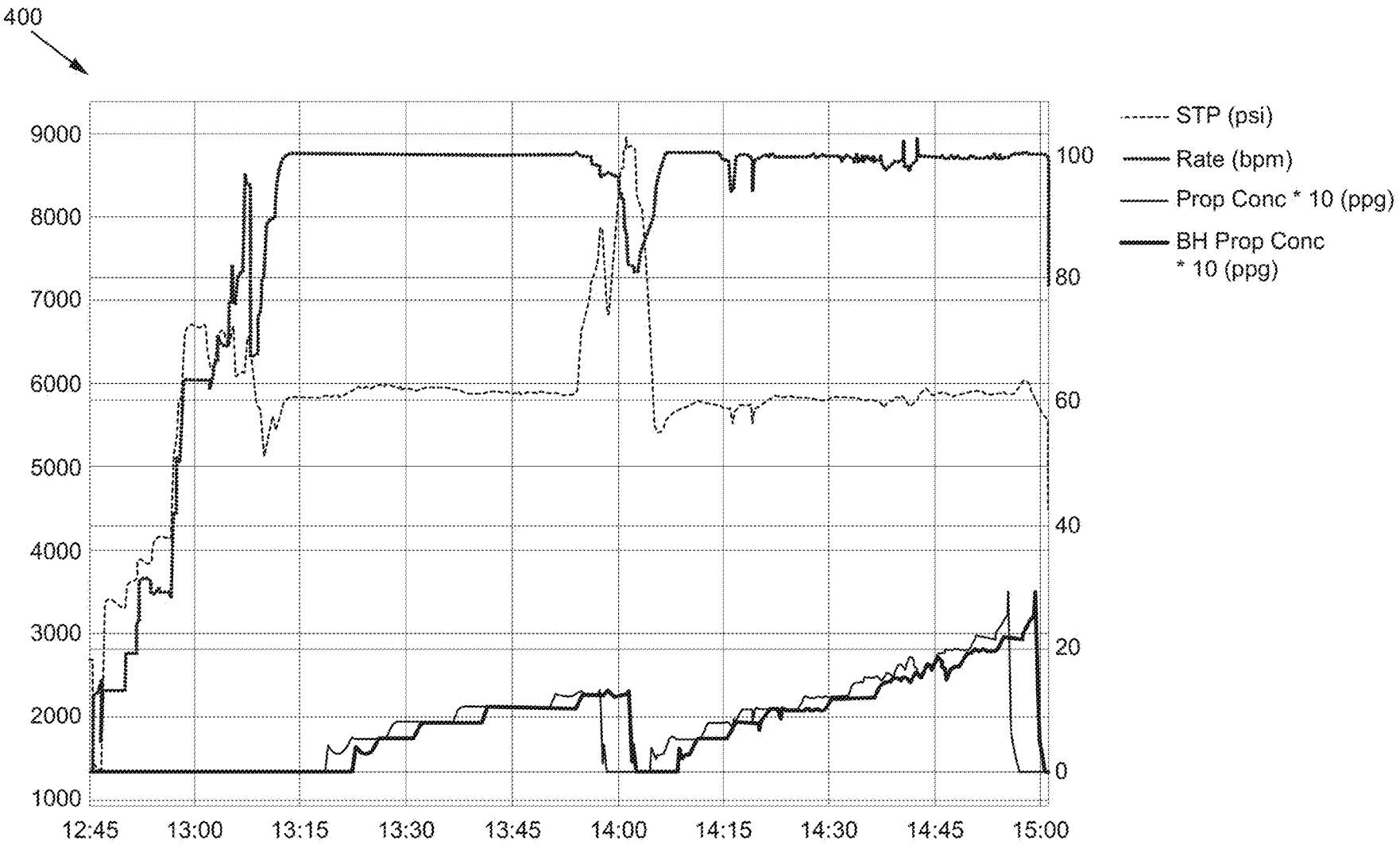
Figure 5:
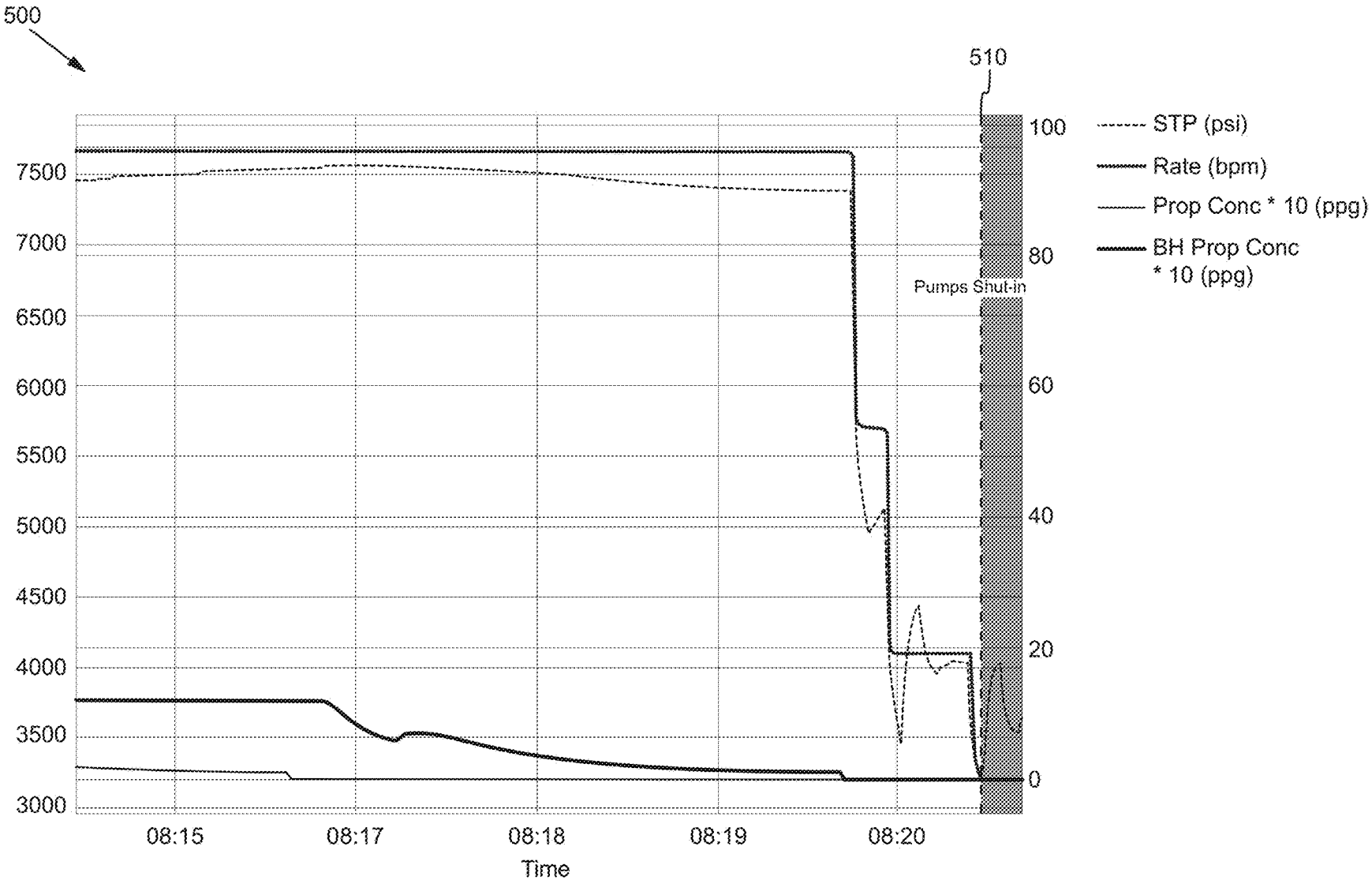
Figure 6:
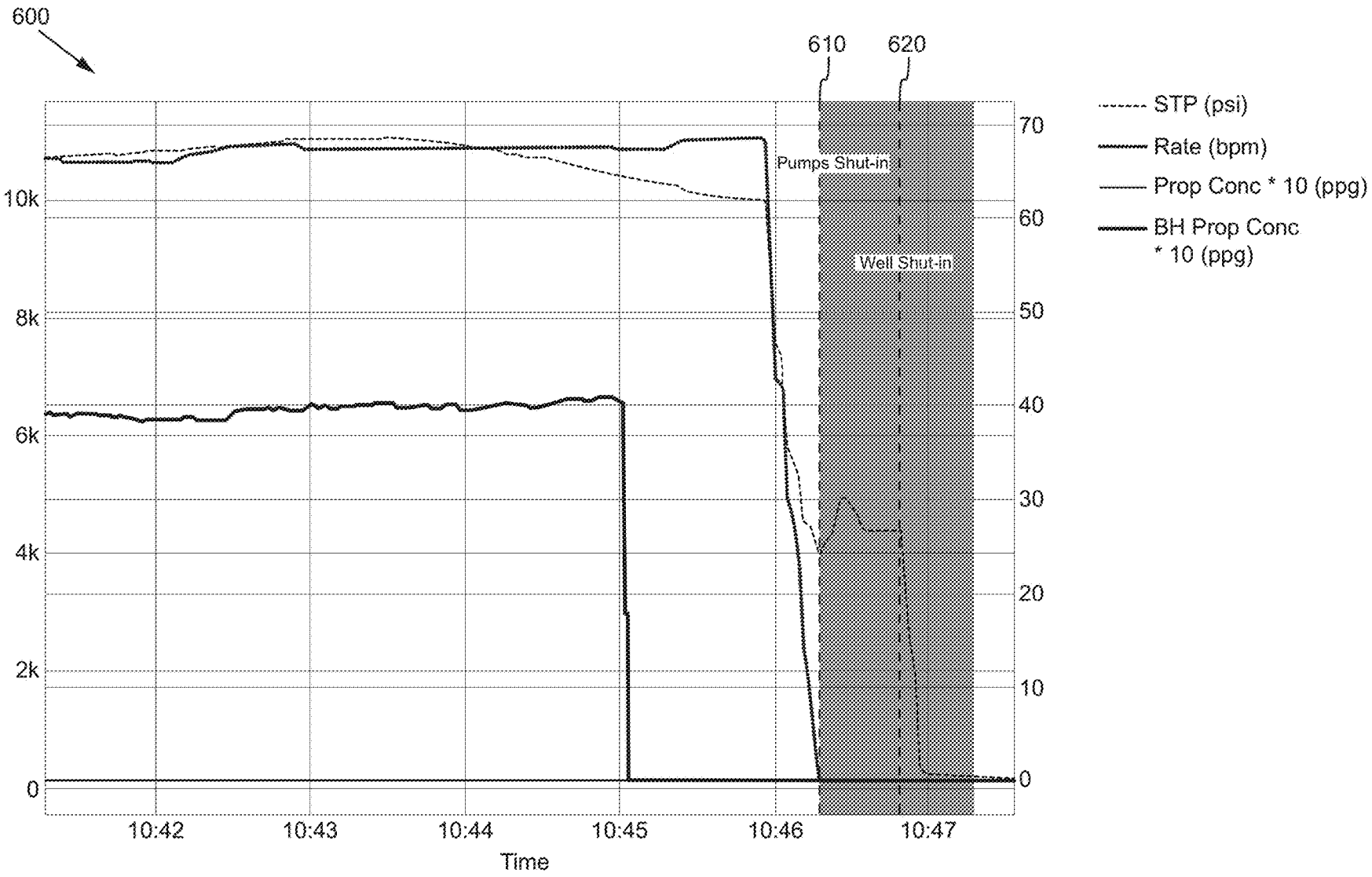
Figure 7:
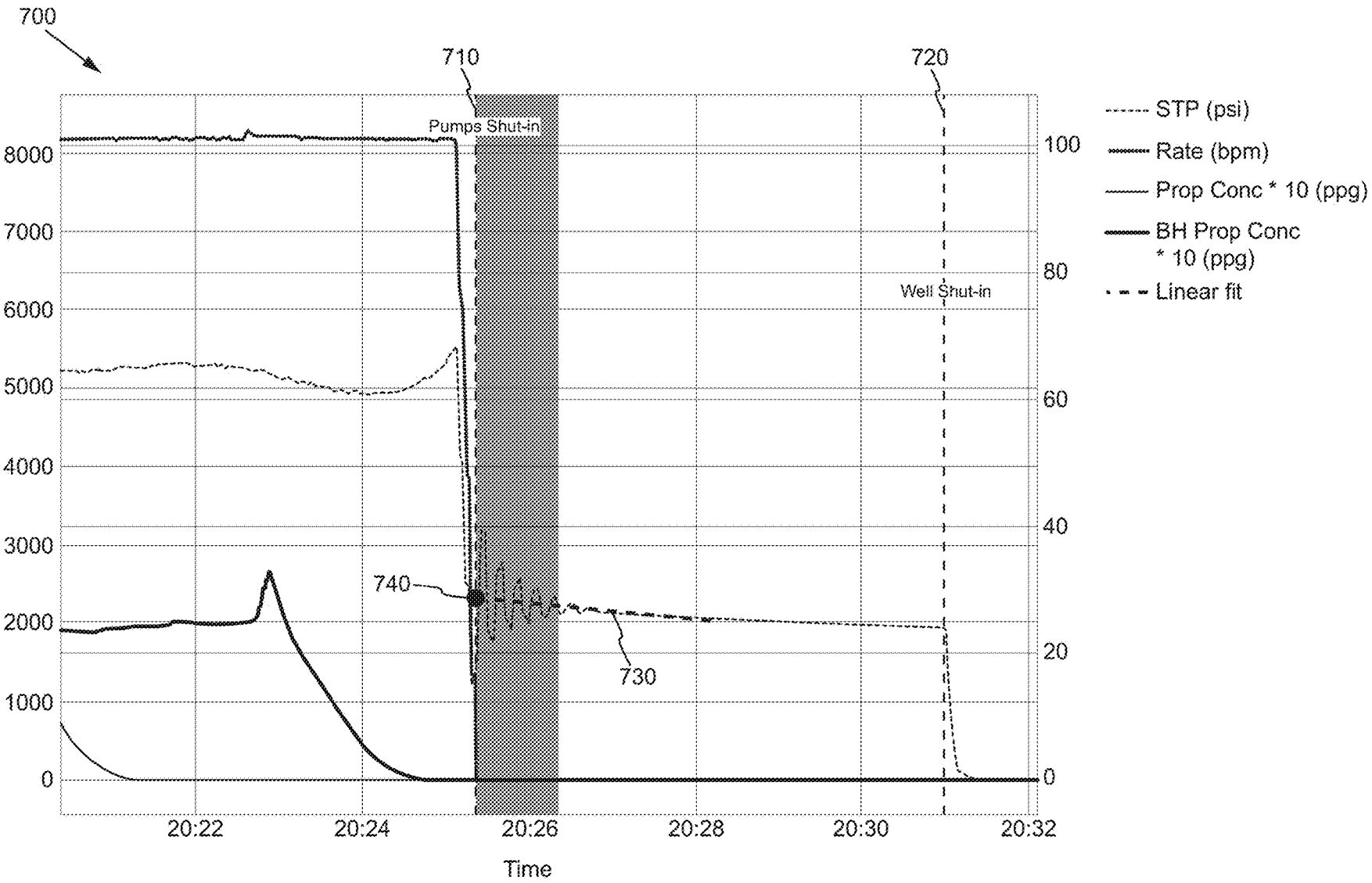
Figure 8:
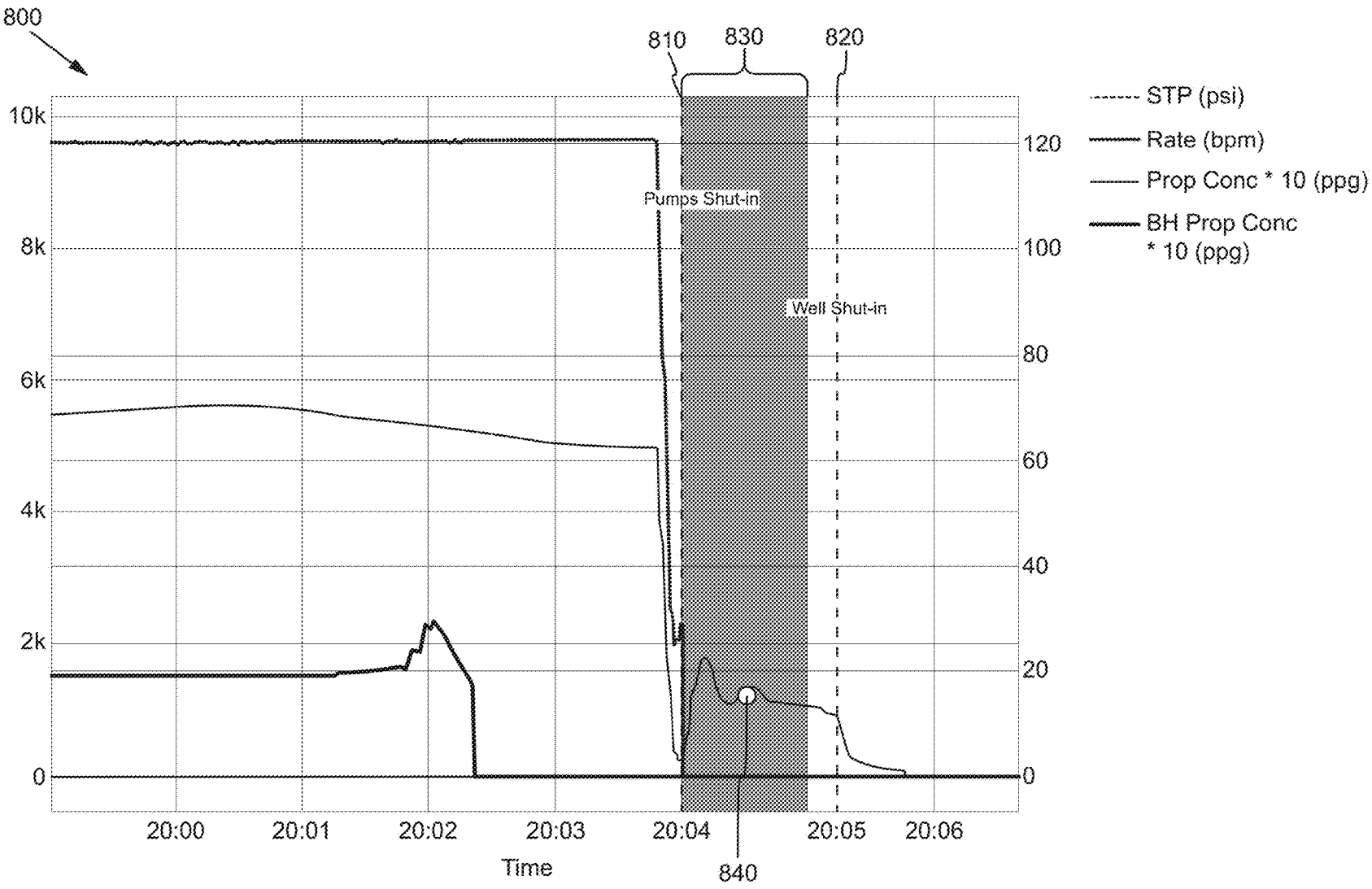
Figure 9:
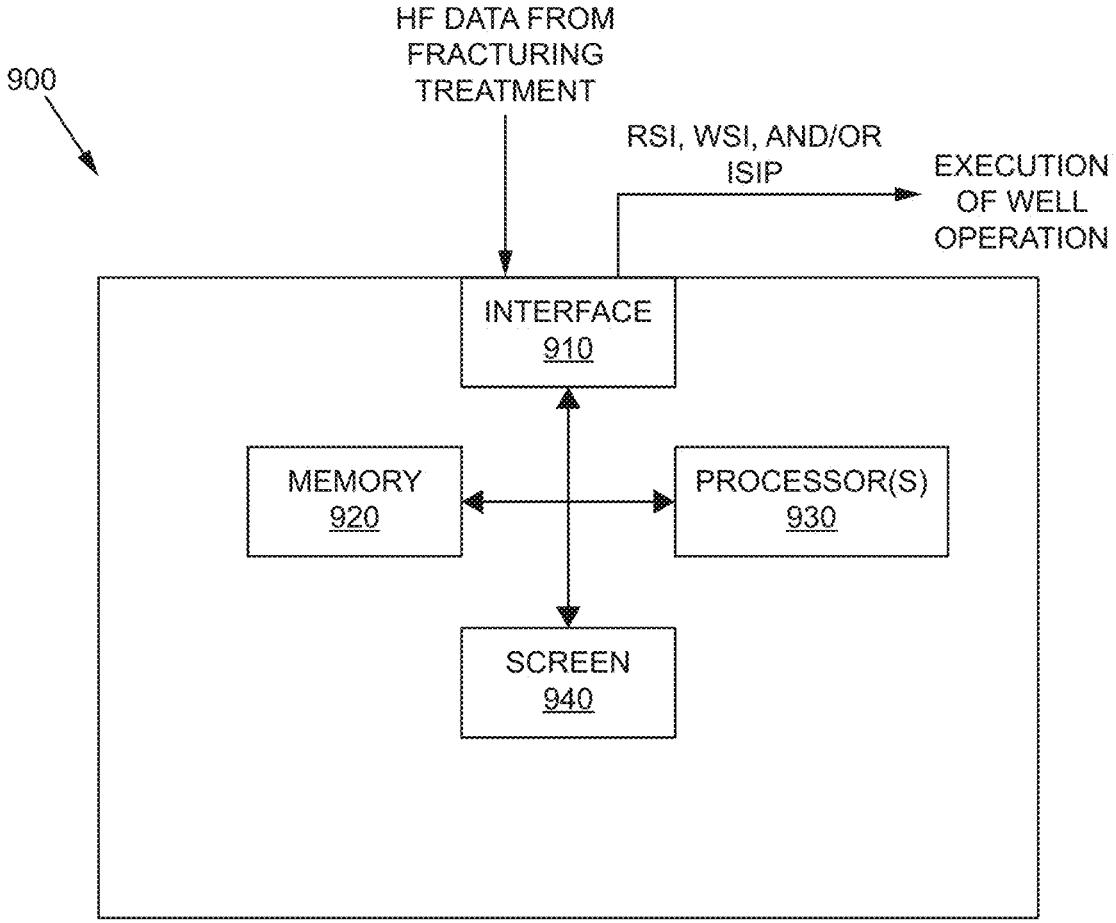

FIGS. 4, 5, and 6 illustrate charts of examples of HF data that is insufficient or inadequate for automatically determining ISIP according to the principles of the disclosure;

FIG. 7 provides a chart illustrating an example of using a linear fit method for determining a value for ISIP according to the principles of the disclosure;

FIG. 8 provides a chart illustrating an example of using an averaging method for determining a value for ISIP according to the principles of the disclosure; and FIG. 9 illustrates a block diagram of an example computing system configured to automatically determine shut-in parameters from HF data according to the principles of the disclosure.

DETAILED DESCRIPTION

Manually reviewing the hydraulic fracturing data and identifying parameters is a visual process of estimating that is typically performed by a geologist or engineer. Such visual estimations or "eyeballing" is prone to errors, time consuming, and is usually inconsistent due to different levels of expertise of those who are doing the visual analysis. Since the parameters, such as shut-in parameters, can be used to make decisions regarding not only the existing wellbore but other wellbores in a reservoir, errors can be compounded. As such, a more accurate, consistent, and faster analysis process would be beneficial to fracturing.

The disclosure provides an automated process of identifying shut-in parameters of a hydraulic fracturing operation from hydraulic fracturing treatment (HF) data. The HF data can be collected in real time during a hydraulic fracturing treatment. The HF data can be obtained, for example, from various sensors, equipment, or systems that are typically used in hydraulic fracturing treatments or present at a well site. The HF data can include surface treatment pressure (STP), flow or slurry rate, surface proppant concentration (SPC), and bottom hole proppant concentration (BHPC). The STP can be in pounds-per-square inch (psi), the slurry rate in barrels per minute (bpm), and the proppant concentrations SPC and BHPC in pounds per gallon (ppg). The shut-in parameters include Rate Shut-In (RSI) time, Well Shut-In (WSI) time, and Instantaneous Shut-In Pressure (ISIP).

The automated process can determine hydraulic fracturing shut-in parameters without manual user intervention. As such, the disclosed process can replace error-prone manual flag placements and calculations with automated ones, which increases the consistency and reliability of the results, and can enable faster decision-making and actions based on the results.

Figure 1:
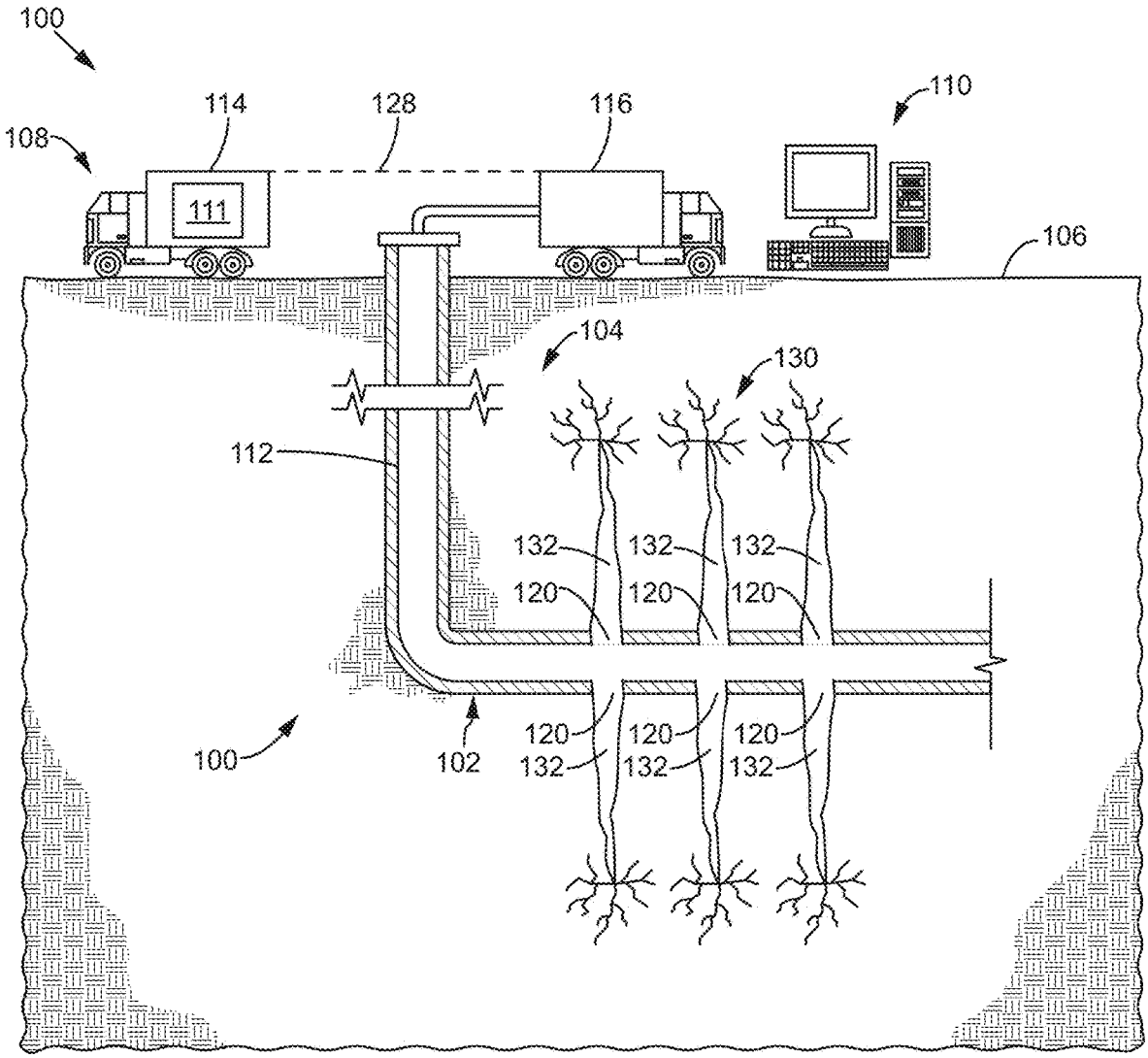
FIG. 1 illustrates a system diagram of an example of a hydraulic fracturing operation at a wellbore.

FIG. 1 illustrates a diagram of an example of a well system 100 undergoing a hydraulic fracturing treatment according to the principles of the disclosure. The well system 100 includes a wellbore 102 that extends into a subterranean region 104 beneath the ground surface 106. Typically, the subterranean region 104 includes a reservoir that contains hydrocarbon resources such as oil or natural gas. For example, the subterranean region 104 may include all or part of a rock formation (e.g., shale, coal, sandstone, granite, or others) that contains natural gas. The subterranean region 104 may include naturally fractured rock or natural rock formations that are not fractured to any significant degree. When the subterranean region 104 includes tight gas formations (i.e., natural gas trapped in low permeability rock such as shale), it is typically desirable to increase the degree of fracturing in the formation to increase the formation's effective permeability.

Accordingly, FIG. 1 includes an injection assembly 108 coupled to a conduit 112 in wellbore 102. The injection assembly 108 includes one or more instrument trucks, represented by a single instrument truck 114 in FIG. 1, and one or more pump trucks, represented by a single pump truck 116 in FIG. 1, that operate to inject fluid via the conduit 112 into the subterranean region 104, thereby opening existing fractures and creating new fractures. The injection assembly 108 may inject fluid into the subterranean region 104 above, at, or below a fracture initiation pressure; above, at, or below a fracture closure pressure; or at another fluid pressure. The fluid reaches the subterranean region 104 via one or more fluid injection locations 120, which in many cases are perforations in the conduit 112. The conduit 112 may include casing cemented to the wall of the wellbore 102, though this is not a requirement and is not shown in the example of FIG. 1. In some implementations, all or a portion of the wellbore 102 may be left open, without casing. The conduit 112 may include a working string, coiled tubing, sectioned pipe, or other types of conduit.

The hydraulic fracture treatment may employ a single injection of fluid to one or more fluid injection locations, or it may employ multiple such injections, optionally with different fluids. Where multiple fluid injection locations are employed, they can be stimulated concurrently or in stages. Moreover, they need not be located within the same wellbore, but may be distributed across multiple wells or multiple laterals within a well.

The instrument truck 114 can be a mobile vehicle or an immobile installation and can include various sensors for measuring temperatures, pressures, flow rates, and other treatment and production parameters. The instrument truck 114 also includes injection treatment control subsystem 111, i.e., a hydraulic fracturing controller, which coordinates operation of the components of the injection assembly 108 to monitor and control the hydraulic fracture treatment applied to the subterranean region 104 through the wellbore 102. The injection treatment control subsystem 111 may include one or more data storage or memories, one or more processors, such as data processing equipment, communication equipment, or other systems and assemblies that control fracturing treatments. The injection treatment control subsystem 111 may receive, generate, execute, or modify a fracturing treatment plan (e.g., a pumping schedule), such as specifying properties for injections, for the hydraulic fracturing treatment applied to the subterranean region 104. The injection treatment control subsystem 111 may be communicably linked to computing system 110 that can calculate, select, or optimize treatment parameters for initiating, opening, and propagating fractures in the subterranean region 104. The computing system 110 represents the various data acquisition and processing systems optionally distributed throughout the injection assembly 108 and wellbore 102, as well as any remotely coupled offsite computing facilities available to the injection treatment control subsystem 111.

The pump truck 116 can be a mobile vehicle or an immobile installation and can include skids, hoses, tubes, fluid tanks, fluid reservoirs, pumps, valves, mixers, or other types of structures and equipment for hydraulic fracturing. The pump truck 116 can be used to supply treatment fluid and other materials (e.g., proppants, stop-loss materials) for the fracturing treatment. The pump truck 116 communicates the treatment fluids into the wellbore 102 at or near the level of the ground surface 106. The pump trucks 116 are coupled to valves and pump controls (not shown) for starting, monitoring, stopping, increasing, decreasing or otherwise controlling pumping as well as controls for selecting or otherwise controlling fluids pumped during the injection treatment.

Communication links, represented by communication link 128, enables the instrument truck 114 to communicate with the pump trucks 116 and other equipment at the ground surface 106. Additional communication links (not shown) enable the instrument trucks 114 to communicate with the computing system 110 and with sensors or data collection apparatus in the wellbore 102, other wellbores, remote facilities, and other devices or equipment. The communication link 128 and the additional communication links can include wired or wireless communications systems, or a combination thereof, that are typically employed in well systems.

The communication link 128 and the additional communication links can be used to communicate HF data to one or more of the computing system 110 and the injection treatment control subsystem 111. The HF data may be obtained in real-time from sensors, pressure meters, flow monitors, microseismic equipment, tiltmeters, or such equipment. The sensors and other data collection devices can conventional devices typically used with fracturing treatments in wellbores. The HF data includes STP, slurry rate, SPC and BHPC. For example, pump truck 116 may include pressure sensors and flow monitors to monitor a STP and slurry flow rate of the hydraulic fracturing fluid at the surface 106 during a stimulation operation. Other sensors can be positioned at the surface to obtain the SPC and downhole to obtain the BHPC.

FIG. 1 shows that a fracturing treatment has fractured the subterranean region 104. FIG. 1 shows examples of dominant fractures 132 extending into natural fracture networks 130, the dominant fractures having been formed and opened by fluid injection through perforations 120 in the conduit 112 along the wellbore 102. Generally, induced fractures may extend through naturally fractured rock, regions of un-fractured rock, or both. The injected fracturing fluid can flow from the dominant fractures 132, into the rock matrix, into the natural fracture networks 130, or in other locations in the subterranean region 104. The injected fracturing fluid can, in some instances, dilate or propagate the natural fractures or other pre-existing fractures in the rock formation. It should be noted that the induced hydraulic fractures can interact with each other and with the existing natural fractures, thus generating a complex fracture network structure.

Figure 2:
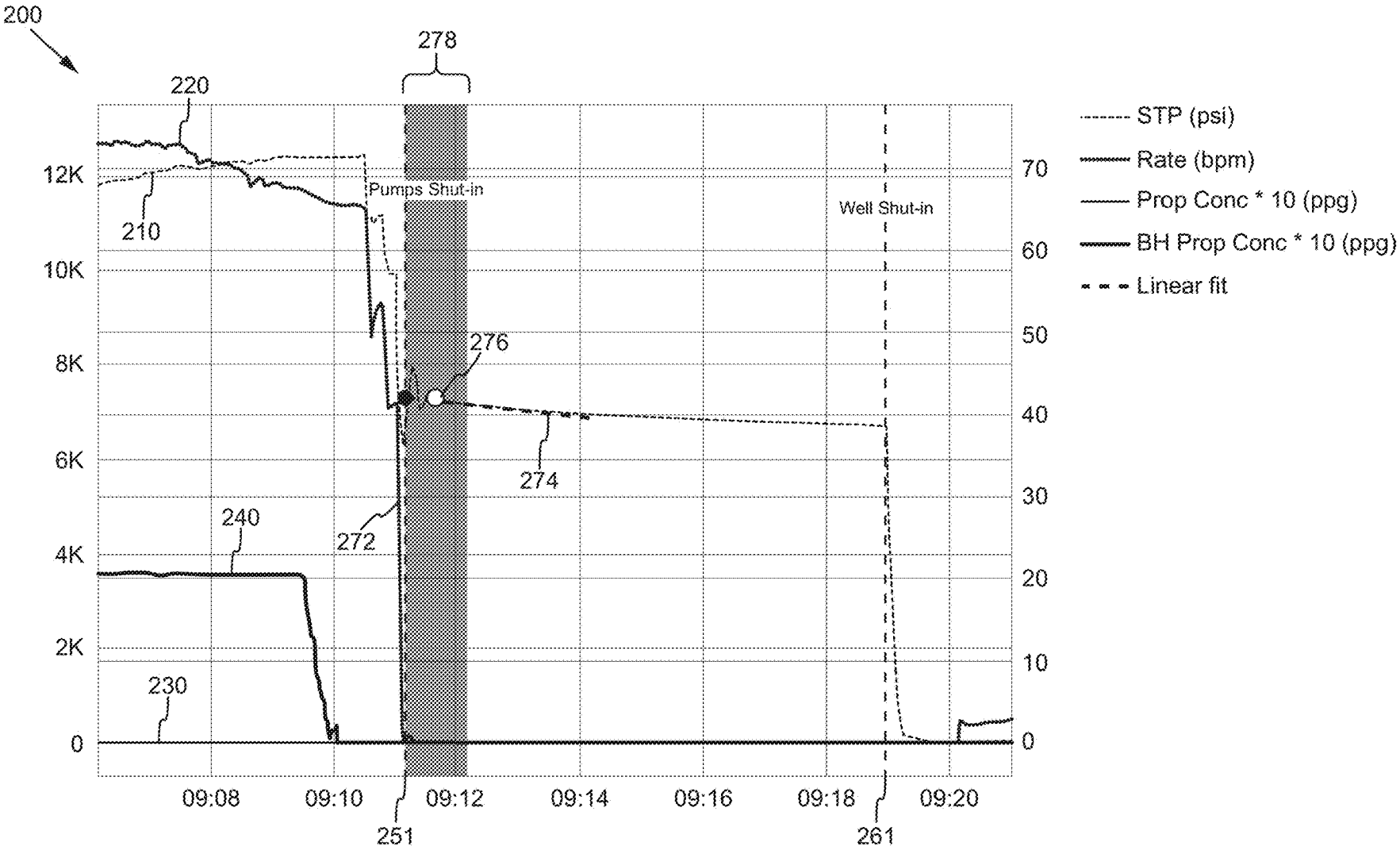
FIG. 2 illustrates a diagram of an example of a chart of HF data from a hydraulic fracturing treatment and shut-in parameters that are automatically determined using the HF data according to the principles of the disclosure.

In addition to the functions described above, the computing system 110, the injection treatment control subsystem 111, or a combination of both can be configured to perform or direct operation of the illustrative systems and methods described herein, such as automatically determining shut-in parameters of a hydraulic fracturing treatment. For example, the computing system 900, such illustrated in FIG. 9, or the method 300 of FIG. 3 can be implemented at least in part by the computing system 110, the injection treatment control subsystem 111, or a combination thereof. FIG. 2 provides an example of the shut-in parameters that can be automatically determined from HF data. The shut-in parameters can be automatically determined in real time during a hydraulic fracturing treatment or post job.

FIG. 2 illustrates a diagram of an example of a chart 200 of HF data from a hydraulic fracturing treatment and shut-in parameters that are automatically determined using the HF data according to the principles of the disclosure. The x axis of chart 200 is time, the left y axis is STP (psi), and the right y axis corresponds to slurry rate (bpm), SPC*10 (ppg) and BHPC*10 (ppg). Chart 200 provides a visual representation of the HF data and time points corresponding to the shut-in parameters. The HF data shown in chart 200 includes STP 210, slurry rate 220, SPC 230 and BHPC 240. Different time points associated with shut-in parameters, which are automatically calculated using the HF data, are also identified in chart 200. The RSI time is identified by dashed line 251 and the WSI time is identified by dashed line 261.

Figure 3:
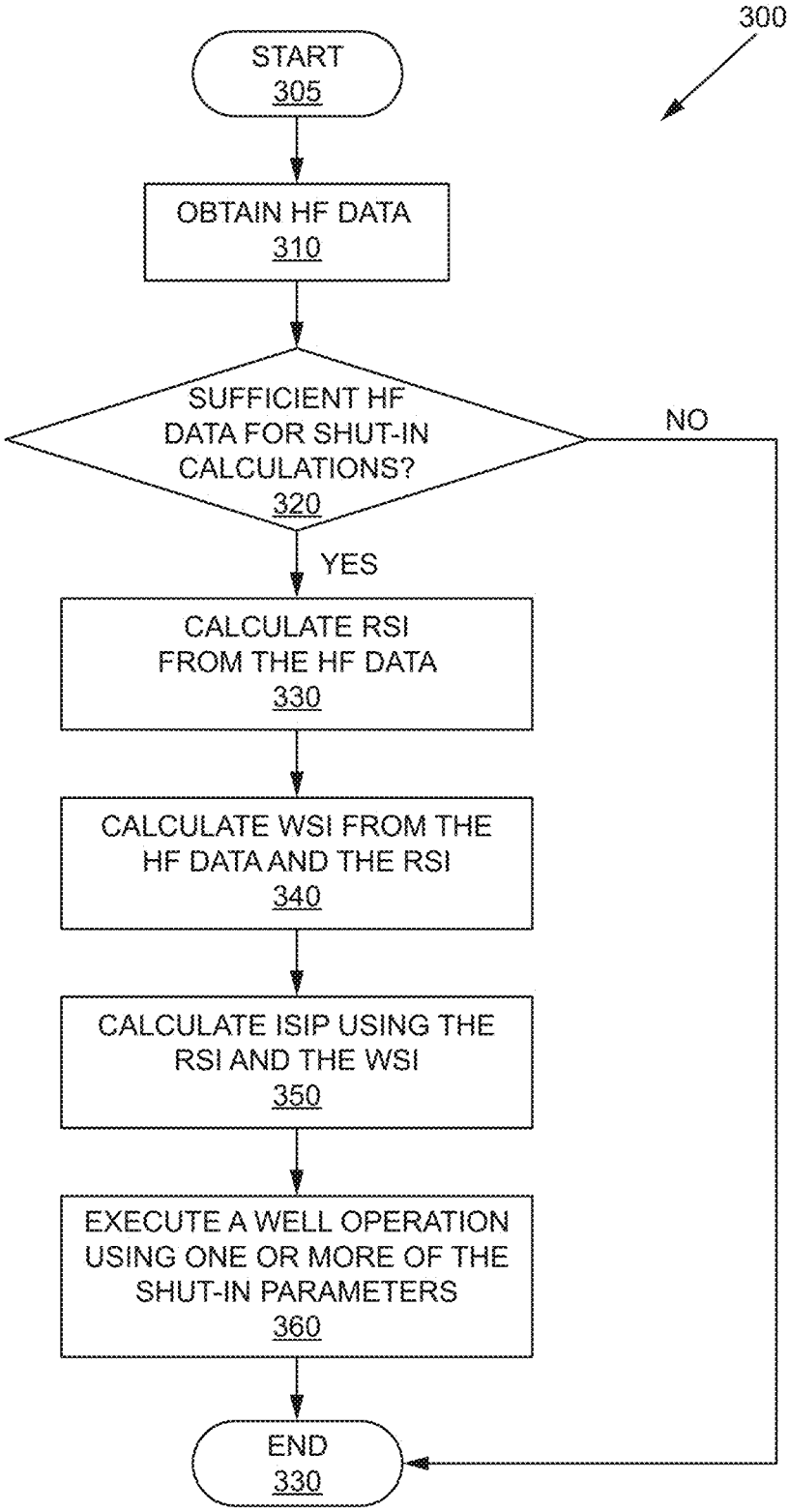
FIG. 3 illustrates a flow diagram of an example method of automatically determining shut-in parameters of a hydraulic fracturing treatment carried out according to the principles of the disclosure.

Method 300 of FIG. 3 can be used for determining the RSI time, WSI time, and an ISIP value. The RSI and WSI time points of the hydraulic fracturing treatment are automatically calculated from the HF data. Based on these two time points, a value for ISIP can then be automatically calculated. Different methods can be used to calculate the pressure value of the ISIP at a particular time point using the RSI and the WSI. Point 272 represents determining a value for ISIP using a linear fit method and point 276 represents determining a value for ISIP using an averaging method. The linear fit is represented by dashed line 274 and a time interval 278 that can be used for the averaging method is also noted as an example.

FIG. 3 illustrates a flow diagram of an example method of automatically determining shut-in parameters of a hydraulic fracturing treatment carried out according to the principles of the disclosure. One or more of the steps of method 300 can be carried out by a series of operating instructions, which causes at least one processor to implement one or more of the steps. The series of operating instructions correspond to an algorithm or algorithms that, for example, automatically determine shut-in parameters for a hydraulic fracturing operation based on HF data. The series of operating instructions can be stored on a non-transitory computer-readable medium of a computer program product. The non-transitory computer-readable medium could be any type of non-transitory computer-readable medium, e.g., a solid-state memory, a fixed optical disk, etc. Multiple thresholds are used in method 300 for verification and qualification. The thresholds can be predetermined based on historical data or dynamically determined based on the HF data. At least a portion of the method 300 can be performed by a computing system, such as computing system 110 of FIG. 1 or computing system 900 of FIG. 9. FIGS. 4-8 are referenced in the discussion of method 300 to visually represent the automated process. Method 300 begins in step 305.

In step 310, HF data is obtained. The HF data can be obtained from various sensors that typically collect data during hydraulic fracturing treatments. The HF data can be transmitted to a computing system, such as, via conventional means used in the industry. The HF data includes STP, slurry rate, SPC and BHPC.

In step 320 a determination is made if there is sufficient HF data to automatically determine the shut-in parameters. There are various scenarios where the received HF data does not allow determining one or more of the shut-in parameters. Method 300 can check to verify there is sufficient HF data for calculating RSI, WSI, and ISIP before proceeding. If not, method 300 continues to step 370 and ends. In such scenarios, the HF data may be manually reviewed to determine one or more of the shut-in parameters. An initial check of the HF data in step 320 may indicate there is sufficient HF data to proceed. However, as indicated in the below discussion when determining the RSI time, the WSI time, or the ISIP, instances can arise where there is inadequate or a sufficient amount of available HF data to complete a calculation. As with step 320, when this occurs method 300 continues to step 370 and ends. Method 300 can restart after an amount of time to allow for additional HF data to be received. The algorithm corresponding to the method 300 can be run in real-time at a predetermined interval, such as, for example, every ten seconds, until it succeeds or the stage ends. FIGS. 4, 5, and 6 illustrate examples of insufficient or inadequate HF data for automatically determining ISIP according to the principles of the disclosure.

FIG. 4 illustrates a diagram of chart 400 of HF data where there is no RSI or WSI. As such ISIP cannot be calculated. FIG. 5 illustrates a diagram of chart 500 demonstrating when HF data ends abruptly and there is insufficient HF data to calculate ISIP and WSI even though RSI time 510 can be determined. In FIG. 6, the HF data of chart 600 illustrates an example where RSI time 610 and WSI time 620 are too close to allow calculating ISIP. When determining in step 320 that sufficient HF data is received, method 300 continues to step 330.

In step 330, RSI time is calculated using the HF data. RSI time can be calculated by identifying time points using the SPC, the BHPC and the slurry rate. For example, the latest time at which SPC goes below a threshold is identified as a first time point. Subsequent to the first time point (i.e, moving forward in time), a second time point is identified where the slurry rate goes below a threshold and the BHPC goes below a threshold. The second time point is set as the RSI. The validity of the RSI time can be checked by verifying the absence of a slurry rate spike immediately or at least promptly following the RSI. For example, the slurry rate can be checked within a set time range or at a set time, such as one minute, after RSI to determine if the slurry rate goes above a set threshold. The threshold can be, for example, 10 bpm. If the slurry rate goes above the threshold, then the RSI is not valid. If no slurry rate spike is present after checking, the RSI time is considered valid and method 300 continues to step 340. If a slurry rate spike is present after checking, the second time point is not set as the RSI time. As such, the RSI time is marked as incomplete and further calculations cannot be made. As such method 300 continues to step 370 and ends.

WSI time is calculated in step 340 using the HF data and the RSI time. WSI time can be calculated by identifying time points using the STP. For example, a third time point is identified subsequent to the RSI time, (i.e., by moving forward in time) where the STP goes below threshold. A check can then be performed to verify that the third time point is not part of a water-hammer signal by checking the slope of the STP in the vicinity of the identified third time point. The slope can be checked within a determined window to see if the slope exceeds a particular threshold. The window and threshold can be, for example, five seconds and 100 psi/sec. If the slope of the STP exceeds a threshold, then the third time point corresponds to the water-hammer signal and is not the WSI time. Another time point subsequent to the third time point, referred to as a subsequent time point, can then be identified as a possible WSI time by moving forward in time to where the STP goes below the threshold. The subsequent time can also be checked to confirm the subsequent time point is not part of the water-hammer signal. More than one subsequent time point can be identified when the identified time points fail the water-hammer signal test. If a valid time point is identified, such as the third time point or a subsequent time point, then the time point is marked as a pseudo-WSI time. From the pseudo-WSI time, the STP is analyzed before the pseudo-WSI time (i.e., moving backward in time) until a major slope change in STP is identified as a fifth time point. If this fifth time point is subsequent to the RSI, then the fifth time point is identified as the true WSI time. If the fifth time point is before the RSI, then the fifth time point is invalid as the true WSI time and is ignored. As such, method 300 continues to step 370 and ends. When the WSI time is determined, i.e., the true WSI time, method 300 continues to step 350.

The ISIP is calculated in step 350 using the RSI and the WSI times. The ISIP can be calculated via various methods using the RSI and the WSI times. For example, a linear fit method, an averaging method, or a quadratic fit method can be used to calculate the ISIP. Regardless the method, a determination can be first made based on the values of RSI and WSI whether or not the ISIP calculation can be performed. The determination can be based on factors that include (but are not limited to) the following scenarios: (a) RSI cannot be determined; (b) there is insufficient data after RSI; (c) incomplete shut-in detected (d) WSI is within 1 min of RSI.

For calculating the ISIP using a linear fit method, a maximum calculation interval after RSI time is selected. The maximum calculation interval is a time interval that can be predetermined. The maximum calculation interval can be based on historical data and input by a user. The maximum calculation interval can also by dynamically determined by method 300 based on at least some of the HF data.

Inside the maximum calculation interval, a sliding window of fixed length (i.e., time) is moved until a good linear fit (where "good" is defined by a fitting error being below a threshold) can be performed on the STP versus time data inside the sliding window. With the linear fit method, a moving window is being evaluated over a period of time to determine when a linear fit is obtained that is good enough, i.e., satisfies the threshold. FIG. 7 provides a chart 700 illustrating an example of using a linear fit method for determining a value for ISIP. In chart 700, both RSI 710 and WSI 720 times are identified and a linear fit can be determined. Dashed line 730 and point 740 are also denoted to represent the linear fit and a value of the ISIP, respectively.

An averaging method can also be used to calculate the ISIP. The averaging method may be used if a linear fit cannot be found. As such, calculating ISIP can be a sequential process wherein a linear fit method is first tried and then an averaging method is performed if a linear fit cannot be found.

For the averaging method, an average value of the STP over a time interval is determined to obtain the ISIP. FIG. 8 provides a chart 800 illustrating an example of using an averaging method for determining a value for ISIP. In chart 800, the available HF data between the two shut-in parameters RSI 810 and WSI 820 times is limited and insufficient to allow using a fitting method to determine ISIP. As such, an averaging method is used to determine a value for ISIP. In addition to RSI 810 and WSI 820 times, time interval 830 that is used for averaging is shown. Point 840 is denoted to indicate the value of ISIP.

A quadratic fit method can also be used to determine ISIP when sufficient pressure decay data is available. For example, science wells often look for pressure decline behavior over time when fracking in order to understand the rock and reservoir properties. As such, sufficient pressure decline data associated with fracturing of science wells is often available for calculating ISIP using a quadratic fit method. A sufficient amount of pressure data can be used as a trigger for performing the quadratic fit method. The trigger or threshold can be at least 20 minutes of decline after RSI and before WSI.

For the quadratic fit method, the oscillatory portion of STP data is removed until a good quadratic fit can be found. A conventional quadratic fit algorithm can be used to determine the fit. If a quadratic fit is found, the STP is extrapolated to the RSI and a fit at the RSI from the extrapolated STP is used to obtain the ISIP.

Method 300 continues to step 360 wherein at least one well operation is executed using one or more of the automatically determined shut-in parameters. The well operation can be for the current wellbore undergoing the hydraulic fracturing treatment or for another wellbore, such as one located in the same reservoir of the current wellbore. For example, RSI and/or WSI can be used for accurate tracking of billable pumping hours, such as performed by pump truck 116 of FIG. 1. Regarding the ISIP, geomechanical conditions can be estimated such as minimum principal stress, fracture gradient, extent of stress shadowing and stress interference, etc. The design and execution of subsequent treatment stages can then be performed using the geomechanical understanding. For example, significant build-up of ISIP with stages can indicate undesirable stress shadowing. This information can be used to alter stage designs such as pumping small acid stages and/or increasing stage spacing and/or cluster spacing until ISIP shows that stress shadowing has been relieved. Another application example is in multi-well jobs where an increase in ISIP can indicate undesirable stress interference. In these cases, the well sequencing may be changed until ISIP shows that stress interference has decreased to an acceptable level. Another application of ISIP can be in the design of in-fill wells where the stage design is made smaller or larger based on the extent of stress interference while treating the outer wells observed through the evolution of ISIP.

The automatically determined shut-in parameters also allows flexibility in working with transitions of treatment stages and can be used to adapt different stage transition times. When sufficient HF data is available after RSI, method 300 can also be used to provide estimate of fluid leak-off rate and reservoir properties. Various other well operations can also be executed using the shut-in parameters. Method 300 continues to step 370 and ends.

FIG. 9 illustrates a block diagram of an example computing system 900 configured to automatically determine shut-in parameters from HF data according to the principles of the disclosure. The computing system 900 can be located proximate a well site, or a distance from the well site, such as in a data center, cloud environment, corporate location, a lab environment, or another location. Computing system 900 can be a distributed system having a portion located proximate a well site and a portion located remotely from the well site. Computing system 110 of FIG. 1, for example, can be configured to perform at least a portion of the functionality of computing system 900. Computing system 900 includes a communications interface 910, a memory (or data storage) 920, one or more processors 930, and a screen 940.

Communication interface 910 is configured to transmit and receive data. For example, communication interface 910 can receive HF data from sensors and equipment, such as from pump truck 116 at surface 106, in real-time during a hydraulic fracturing treatment. The HF data can also be received after the hydraulic fracturing treatment for post-job analysis.

Memory 920 is a non-transitory computer readable medium that can store a series of operating instructions that direct the operation of the one or more processors 930 when initiated thereby. The operating instruction include code representing the algorithms for automatically determining shut-in parameters as described herein. For example, the algorithms can correspond to method 300 of FIG. 3. The HF data and code for employing the HF data for a hydraulic fracturing treatment can also be stored in memory 920. Memory 920 can be a distributed memory.

The one or more processors 930 are configured to automatically calculate shut-in parameters RSI time, WSI time, and ISIP from the HF data. The one or more processors 930 can also be configured to cause adjustments to one or more hydraulic fracturing treatments based on one or more of the shut-in parameters. The determined shut-in parameters can also be provided to another well control system that uses the shut-in parameters when executing a well operation. For example, one or more of the shut-in parameters can be transmitted to injection treatment control subsystem 111 and used to modify a treatment stage. The one or more processors 930 include the logic to communicate with communications interface 910 and memory 920, and perform the function of automatically determining shut-in parameters using the HF data.

Screen 940 is configured to display outputs from the one or more processors 930, such as the calculated shut-in parameters, charts identifying the shut-in parameters with respect to the HF data (similar to FIG. 2), details of the shut-in parameters, or a combination thereof. Screen 940 can also display a monitoring status of the hydraulic fracturing treatment.

Accordingly, results of the shut-in parameter calculations can be displayed locally on screen 940 in real-time and can be transmitted in real-time to a cloud-based display. Local and cloud-based dashboards can be displayed that may include identifying flags for RSI and WSI times, as well as identifiers for ISIP values, its calculation ranges, identified slopes, etc. The dashboards, local or cloud-based, can allow for real-time access and view of the data for decision-making regarding executing well operations.

Some of the techniques and operations described herein may be implemented by a one or more computing systems. In various instances, a computing system may include any of various types of devices, including, but not limited to, handheld mobile devices, tablets, notebooks, laptops, desktop computers, workstations, mainframes, distributed computing networks, and virtual (cloud) computing systems.

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate arrays (FPGA), or another type of computer processing device (CPD). The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions and modifications may be made to the described embodiments. It is also to be understood that the terminology used herein is for the purpose of describing particular embodiments only, and is not intended to be limiting, because the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein.

What is claimed is:

1. A method for automatically determining hydraulic fracturing parameters, comprising:

obtaining hydraulic fracturing treatment (HF) data, wherein the HF data includes one or more of surface treatment pressure (STP), slurry rate, surface proppant concentration (SPC), or bottom hole proppant concentration (BHPC);

determining a Rate Shut-In (RSI) time from the HF data;

determining a Well Shut-In (WSI) time using the RSI time;

calculating an Instantaneous Shut-In Pressure (ISIP) based upon both the RSI and the WSI times, wherein determining the RSI time, the WSI time and calculating the ISIP value are automatically performed by one or more processors, and modifying at least one of the STP, slurry rate, SPC, or BHPC using one or more of the RSI time, the WSI time, or the ISIP; and executing a hydraulic fracturing treatment using the at least one modified STP, slurry rate, SPC, or BHPC.

2. The method as recited in claim 1, wherein the calculating the ISIP uses a linear fit method.

3. The method as recited in claim 1, wherein the calculating the ISIP uses an averaging method.

4. The method as recited in claim 1, wherein the calculating the ISIP uses a quadratic fit method based on an amount of pressure decline data available from the HF data.

5. The method as recited in claim 1, wherein calculating the ISIP includes starting with a linear fit method and using an averaging method when the linear fit method is unsuccessful.

6. The method as recited in claim 1, wherein the method is performed in real time.

7. The method as recited in claim 1, wherein obtaining the HF data occurs during the hydraulic fracturing treatment.

8. The method as recited in claim 1, wherein obtaining the HF data occurs before the hydraulic fracturing stage.

9. The method as recited in claim 1, further comprising visually providing a representation of at least one of ISIP, RSI, and WSI with respect to the HF data.

10. A system for automatically determining shut-in parameters from hydraulic fracturing treatment (HF) data from a wellbore, comprising:

an interface for receiving HF data, wherein the HF data includes one or more of surface treatment pressure (STP), slurry rate, surface proppant concentration (SPC), or bottom hole proppant concentration (BHPC); and one or more processors to perform operations including:

determining a Rate Shut-In (RSI) time from the HF data;

determining a Well Shut-In (WSI) time using the RSI time;

calculating an Instantaneous Shut-In Pressure (ISIP) based upon both the RSI and the WSI times, wherein determining the RSI time, the WSI time and calculating the ISIP are automatically performed by one or more processors;

modifying at least one of the STP, slurry rate, SPC, or BHPC using one or more of the RSI time, the WSI time, or the ISIP; and executing a hydraulic fracturing treatment using the at least one modified STP, slurry rate, SPC, or BHPC.

11. The system as recited in claim 10, wherein the calculating the ISIP uses a linear fit method.

12. The system as recited in claim 10, wherein the calculating the ISIP uses an averaging method.

13. The system as recited in claim 10, wherein the calculating the ISIP uses a quadratic fit method based on an amount of pressure decline data available from the HF data.

14. The system as recited in claim 10, wherein calculating the ISIP is a sequential process that starts with a linear fit method and proceeds to another method when the linear fit method is unsuccessful.

15. The system as recited in claim 10, wherein the operations for determining the RSI time, determining the WSI time, and calculating the ISIP are performed in real time.

16. The system as recited in claim 10, further comprising a screen and the operations further include providing a visual representation of the ISIP with respect to the HF data on the screen.

17. The system as recited in claim 16, wherein the operations further include providing a visual representation of at least one of the RSI and the WSI with respect to the HF data on the screen.

18. The system as recited in claim 10, wherein obtaining the HF data occurs before the hydraulic fracture treatment.

19. A computer program product having a series of operating instructions stored on a non-transitory computer readable medium that direct one or more processors to perform operations for automatically determining hydraulic fracturing parameters, the operations comprising:

determining a Rate Shut-In (RSI) time from hydraulic fracturing treatment (HF) data, wherein the HF data includes one or more of surface treatment pressure (STP), slurry rate, surface proppant concentration (SPC), or bottom hole proppant concentration (BHPC);

determining a Well Shut-In (WSI) time using the RSI time;

calculating an Instantaneous Shut-In Pressure (ISIP) based upon both the RSI and the WSI times, wherein determining the RSI time, the WSI time and calculating the ISIP are automatically performed;

modifying at least one of the STP, slurry rate, SPC, or BHPC using one or more of the RSI time, the WSI time, or the ISIPU; and executing a hydraulic fracturing treatment using the at least one modified STP, slurry rate, SPC, or BHPC.

20. The computer program product as recited in claim 19, wherein calculating the ISIP is a sequential process that begins with a linear fit method and proceeds to an averaging method when the linear fit method is unsuccessful.

* * * * *